US010534311B2

(12) United States Patent
Yanase et al.

(10) Patent No.: US 10,534,311 B2
(45) Date of Patent: Jan. 14, 2020

(54) WASTE TONER CONTAINER AND IMAGE FORMING APPARATUS INCLUDING SAME

(71) Applicant: Konica Minolta, Inc., Chiyoda-ku, Tokyo (JP)

(72) Inventors: Shinji Yanase, Shinshiro (JP); Satoshi Fujii, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/807,329

(22) Filed: Nov. 8, 2017

(65) Prior Publication Data

US 2018/0150020 A1 May 31, 2018

(30) Foreign Application Priority Data

Nov. 30, 2016 (JP) ..... 2016-232763

(51) Int. Cl.

| | |
|---|---|
| ***G03G 21/10*** | (2006.01) |
| ***G03G 15/08*** | (2006.01) |
| ***G03G 21/12*** | (2006.01) |
| ***G03G 15/10*** | (2006.01) |
| ***G03G 21/16*** | (2006.01) |

(52) U.S. Cl.

CPC ..... *G03G 21/105* (2013.01); *G03G 15/0855* (2013.01); *G03G 21/12* (2013.01); *G03G 15/105* (2013.01); *G03G 21/16* (2013.01)

(58) Field of Classification Search

CPC ..... G03G 21/16; G03G 15/105

See application file for complete search history.

(56) References Cited

U.S. PATENT DOCUMENTS

2013/0251433 A1* 9/2013 Toshiyuki ..... G03G 21/10 399/358

2013/0259495 A1* 10/2013 Ota ..... G03G 21/12 399/35

FOREIGN PATENT DOCUMENTS

| | | |
|---|---|---|
| JP | 06-067578 | 3/1994 |
| JP | 2009-092990 | 4/2009 |
| JP | 2010-145812 | 7/2010 |

(Continued)

OTHER PUBLICATIONS

JP_2010145812_A_T MachineTranslation, Japan, 2010, Naruse.*

*Primary Examiner* — Victor Verbitsky

(74) *Attorney, Agent, or Firm* — Squire Patton Boggs (US) LLP

(57) ABSTRACT

A waste toner container provided for use in an image forming apparatus includes: a body receiving, through an inlet, waste toner discharged from the image forming apparatus, and contains the waste toner; a conveyance member conveying the waste toner, which has been received through the inlet; a waste toner deposition chamber disposed downstream of the inlet in a waste toner conveyance direction such that the waste toner that has been conveyed is increasingly deposited therein, the chamber having a light-transmissive window through which amount of the deposited waste toner is optically monitorable from outside of the body; a conductive member disposed on an inner surface of the body so as to come into contact with the waste toner being conveyed; and a connection unit disposed between the conductive member and an earth member provided in the image forming apparatus to electrically connect between the conductive member and the earth member.

26 Claims, 9 Drawing Sheets

(56) References Cited

FOREIGN PATENT DOCUMENTS

| | | |
|---|---|---|
| JP | 2011-039569 | 2/2011 |
| JP | 2014-021363 | 2/2014 |

* cited by examiner

WASTE TONER CONTAINER AND IMAGE FORMING APPARATUS INCLUDING SAME

Japanese Patent Application No. 2016-232763 filed on Nov. 30, 2016, including description, claims, drawings, and abstract, is incorporated herein by reference in its entirety.

BACKGROUND

Technical Field

The present invention relates to a waste toner container that receives, through an inlet thereof, waste toner that is discharged from an image forming apparatus, and contains therein the received waste toner.

Description of the Related Art

An image forming apparatus such as a printer forms a toner image on an image carrier such as a photosensitive drum and an intermediate transfer belt, and transfers the toner image onto a transfer object such as a recording sheet. Such an image forming apparatus generally removes residual toner on the image carrier by a cleaner or the like after the transfer, and contains the removed residual toner in a resin waste toner container as waste toner.

When the waste toner container has become full of waste toner, a user detaches the waste toner container to attach an empty one instead.

One of methods of sensing that a waste toner container has become full of waste toner is to use an optical waste toner sensor. According to this method, a light-transmissive window is provided in for example a side surface of the waste toner container. While the waste toner container is attached to a device body of an image forming apparatus, the waste toner sensor senses full of waste toner in the waste toner container from the window using sensing light that is transmittable through the window.

SUMMARY

Such a waste toner container as described above mostly has a configuration in which a conveyance member such as a conveyance screw conveys waste toner that has fallen immediately below an inlet toward a position distant from the inlet so as to level the waste toner on a bottom surface of the waste toner container. This is in order to prevent continuing deposition of a stack of the waste toner, which has fallen through the inlet, immediately below the inlet in a containing space of the waste toner container.

However, during conveyance of waste toner by the conveyance member, particles of the waste toner float while being frictionally charged due to contact with the bottom surface, a side surface, and the like of the waste toner container. Then, the particles of the waste toner sometimes adhere to an inner surface of a window that is disposed downstream in a waste toner conveyance direction, by the action of an electrostatic force. Especially in the case where toner having a larger charge amount is used due to an increased printing speed, toner tends to adhere to an inner surface of a window with a stronger adhesion force.

Due to an increase of an amount of waste toner adhered to the inner surface of the window as a result of continuance of gradual adherence of waste toner, the waste toner sensor might erroneously sense full of waste toner in the waste toner container though the waste toner container has not yet actually become full of waste toner.

In an image forming apparatus that is for example configured to suspend execution of an image forming job in accordance with sensing results indicating full of waste toner in the waste toner container, it is impossible to execute the image forming job due to such an erroneous sensing. Further, such an erroneous sensing increases burdens on a user such as an unnecessary replacement of the waste toner container.

An object of the present invention is to provide a waste toner container capable of preventing erroneous sensing of full of waste toner and an image forming apparatus including the waste toner container.

To achieve the above object, the present invention provides a waste toner container that is provided for use in an image forming apparatus, the waste toner container comprising: a body that receives, through an inlet thereof, waste toner discharged from the image forming apparatus, and contains therein the waste toner; a conveyance member that conveys the waste toner, which has been received through the inlet; a waste toner deposition chamber that is disposed downstream of the inlet in a waste toner conveyance direction such that the waste toner that has been conveyed by the conveyance member is increasingly deposited therein, the waste toner deposition chamber having a light-transmissive window through which an amount of the deposited waste toner is optically monitorable from outside of the body; a conductive member that is disposed on an inner surface of the body so as to come into contact with the waste toner that is being conveyed by the conveyance member; and a connection unit that is disposed between the conductive member and an earth member that is provided in the image forming apparatus to electrically connect between the conductive member and the earth member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the invention.

In the drawings.

DETAILED DESCRIPTION OF EMBODIMENTS

Hereinafter, one or more embodiments of the present invention will be described with reference to the drawings. However, the scope of the invention is not limited to the disclosed embodiments.

The following explains an embodiment of a waste toner container and an image forming apparatus relating to one aspect of the present invention, by way of a monochrome printer (hereinafter, referred to simply as printer).

(1) Configuration of Printer

Figure 1:
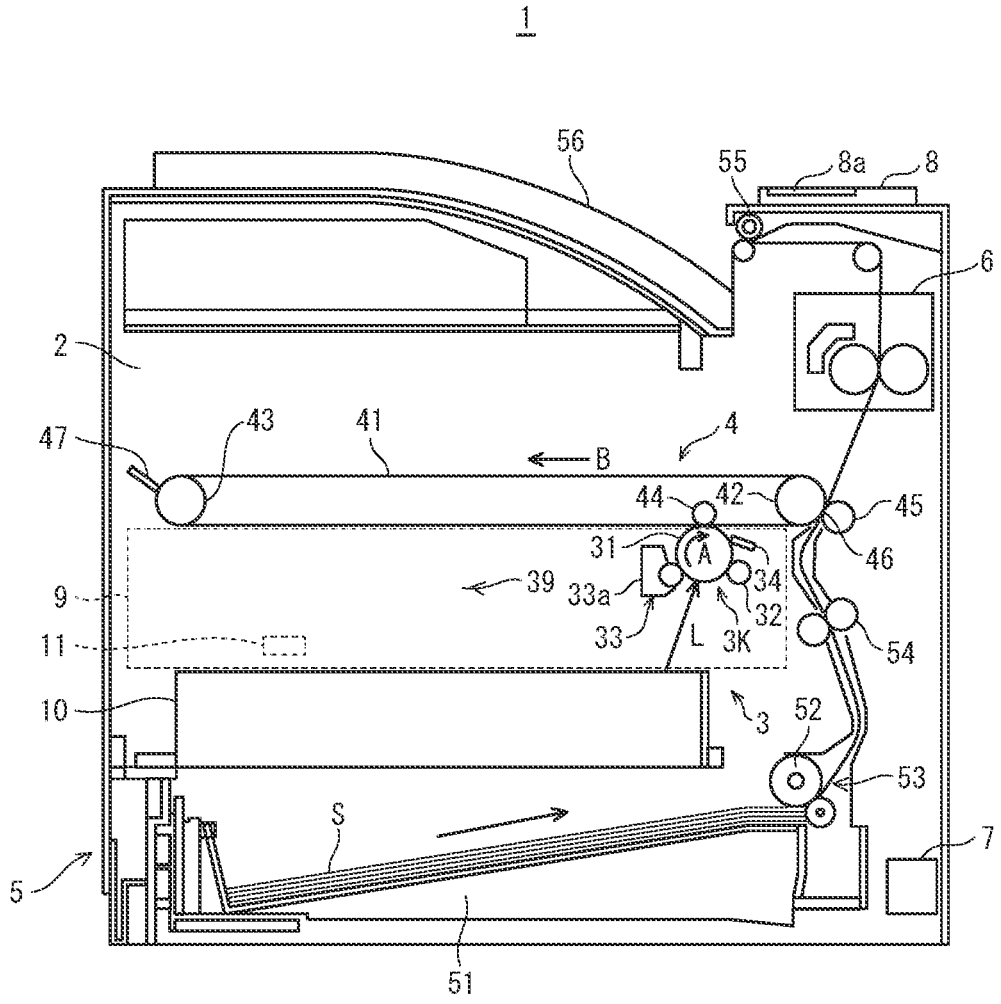
FIG. 1 shows configuration of a printer relating to an embodiment.

FIG. 1 is a schematic front view showing configuration of a printer 1.

As shown in the figure, the printer 1 includes an image forming unit 3, an intermediate transfer unit 4, a sheet feeding unit 5, a fixing unit 6, a control unit 7, an operation panel 8, a waste toner container 9, and so on.

The printer 1 is connected to a network such as a LAN to receive a request for executing a print operation from an external terminal device (not shown). Upon receipt of such a request, the printer 1 forms a toner image of black color, and transfers the toner image onto a recording sheet such that a monochrome image of black color is formed on the recording sheet. The black color is hereinafter referred to as K color.

The image forming unit 3 includes an image forming subunit 3K and an exposure unit 10.

The image forming subunit 3K includes a photoconductive drum 31 that rotates in a direction indicated by an arrow A. The image forming subunit 3K also includes a charger 32, a developing unit 33, a cleaner 34, and so on, which are disposed about the photoconductive drum 31. The cleaner 34 is provided for cleaning the photoconductive drum 31. The image forming subunit 3K forms a toner image of K color on the photoconductive drum 31. The photosensitive drum 31 is used here as an image carrier. Alternatively, a photosensitive belt may be used for example.

The intermediate transfer unit 4 includes an intermediate transfer belt 41 that is disposed above the image forming subunit 3K. The intermediate transfer unit 4 further includes a driving roller 42, a driven roller 43, a primary transfer roller 44, a secondary transfer roller 45, a cleaner 47, and so on.

The intermediate transfer belt 41 is wound around the driving roller 42, the driven roller 43, and the primary transfer roller 44 in taut condition to run in a direction indicated by an arrow B.

The primary transfer roller 44 is disposed to face the photosensitive drum 31 via the intermediate transfer belt 41. The secondary transfer roller 45 is disposed to face the driving roller 42 via the intermediate transfer belt 41.

The exposure unit 10 is disposed below the image forming subunit 3K. In accordance with drive signals output from the control unit 7, the exposure unit 10 emits laser beam L for K color image formation from light-emitting elements so as to irradiate the photoconductive drum 31 charged by the charger 32 for exposure-scanning. As a result of this exposure-scanning, an electrostatic latent image is formed on a circumferential surface of the photosensitive drum 31.

The electrostatic latent image formed on the photoconductive drum 31 is developed with a developer contained in the developing unit 33, such that a toner image of K color is formed on the photoconductive drum 31.

As a developing system in the present embodiment, a so-called trickle development system is adopted here in which a developer including toner is supplied to a housing 33*a* little by little through its supply port, and part of the developer that has become excessive due to oversupply is discharged out of the housing 33*a* through its discharge port.

Since a deteriorated developer is less likely to remain in the housing 33*a* according to this trickle development method, it is possible to suppress deterioration of a developer to realize high image quality. According to the trickle development system, the developer (such as carrier and toner) discharged through the discharge port of the housing 33*a* is transmitted to the waste toner container 9 as unnecessary waste toner that is not used for image formation. Configuration of the waste toner container 9 is described later.

The toner image of K color, which has been formed on the photosensitive drum 31, is primarily transferred onto the intermediate transfer belt 41 by the primary transfer roller 44. At this primary transfer, residual toner, which has not been transferred onto the intermediate transfer belt 41 and thus remains on the photosensitive drum 31, is conveyed to the cleaner 34 by rotation of the photosensitive drum 31. Then, the residual toner on the photosensitive drum 31 is removed by the cleaner 34, and is transmitted to the waste toner container 9 as waste toner.

The sheet feeding unit 5 includes a sheet feeding cassette 51, a pickup roller 52, a pair of timing rollers 54, and so on. The sheet feeding cassette 51 stores therein recording sheets S. The pickup roller 52 picks up the recording sheets S from the sheet feeding cassette 51 piece by piece onto a conveyance path 53. The timing rollers 54 adjust a timing to convey the recording sheet S to a secondary transfer position 46 where the secondary transfer roller 45 contacts the intermediate transfer belt 41.

The timing rollers 54 convey the recording sheet S to the secondary transfer position 46 in accordance with a timing when the toner image of K color, which has been transferred onto the intermediate transfer belt 41, is conveyed to the secondary transfer position 46. Then, in accordance with a timing when the recording sheet S passes through the secondary transfer position 46, the toner image of K color is secondarily transferred onto the recording sheet S by the secondary transfer roller 45.

At this secondary transfer, residual toner, which has not been transferred onto the recording sheet S and thus remains on the intermediate transfer belt 41, is conveyed to the cleaner 47 by rotation of the intermediate transfer belt 41. Then, the residual toner is removed from the intermediate transfer belt 41 by the cleaner 47, and is transmitted to the waste toner container 9 as waste toner.

The recording sheet S, onto which the toner image of K color has been secondarily transferred at the secondary transfer position 46, is conveyed to the fixing unit 6. The fixing unit 6 is disposed above the secondary transfer position 46, and heats and presses the toner image (unfixed image) of K color on the recording sheet S for thermal fixing. After passing through the fixing unit 6, the recording sheet S is discharged out of the printer 1 by a pair of ejecting rollers 55, and is stored in an exit tray 56.

The waste toner container 9 is a container that contains therein waste toner that is discharged from the developing unit 33 and the cleaners 34 and 47. The waste toner container 9 is detachably attached to a device case (body) 2 of the printer 1. In the present embodiment, the waste toner container 9 is specifically attached in an attachment space (not shown) for attaching the waste toner container 9 inside the device body 2. The attachment space is positioned below the intermediate transfer belt 41 and above the paper feed cassette 51 in a height direction of the printer 1, and positioned closer to a device front side of the printer 1 in a longitudinal direction of the printer 1 than the image forming unit 3 and the intermediate transfer unit 4.

When the waste toner container 9 is attached to the device body 2, tips of respective pipes (not shown) provided for the developing unit 33 and the cleaners 34 and 47 are inserted into waste toner inlets (described later) of the waste toner container 9. Discharged waste toner is transmitted toward the inside of the waste toner container 9 through the pipes.

A cover member (not shown) that is openable and closable is provided on the device front side. A user opens and closes the cover member so as to replace the waste toner container 9 with an empty one from the device front side.

The waste toner container 9 has provided therein a waste toner deposition chamber 80 (FIG. 4) having light-transmissive windows as described later. While the waste toner container 9 is attached to the device body 2, the windows of the waste toner deposition chamber 80 are irradiated with sensing light of an optical waste toner sensor 11 that is provided on the side of the device body 2. Then, an amount of the light transmitting through the windows is sensed in order to sense whether or not the waste toner container 9 has become full of waste toner.

The operation panel 8 is disposed at a position where a user standing in front of the printer 1 easily operates. Here, the operation panel 8 is disposed at a position on an upper surface of the device body 2 on the device front side. The operation panel 8 includes keys for receiving execution instructions of various jobs, selection keys for receiving selection instructions of jobs to be executed, and so on from a user. The operation panel 8 further includes a display 8*a* that displays a screen relating to various jobs in accordance with instructions from the control unit 7, a warning message, and so on. The warning message urges a user to replace the waste toner container 9 that has become full of waste toner with an empty one.

Note that the printer 1 has a space 39 between the intermediate transfer belt 41 and the exposure unit 10, except a part where the image forming subunit 3K is provided. This space 39 exists as a result of the printer 1 after a so-called minor configuration modification from a color printer to a monochrome printer. Specifically, the printer 1 is obtained as a result of modification of a tandem-type color printer having image forming subunits for toner image formation of yellow, magenta, cyan, and black colors to a black monochrome printer having only the image forming subunit 3K of toner image formation for black color. More specifically, the printer 1 is obtained as a result of removing the image forming subunits of yellow, magenta, and cyan colors from the tandem-type color printer. Thus, the space 39 corresponds to a part in the color printer where the image forming subunits of yellow, magenta, and cyan colors have been originally disposed.

The waste toner container 9 used for the printer 1 is of the same type as that for color printers. Accordingly, the monochrome printer 1, which is for toner image formation of only a single color of black, has a sufficient space (capacity) for containing waste toner.

In the present embodiment, a mechanism is provided for, when waste toner that is contained in the waste toner container 9 is frictionally charged during conveyance of the waste toner in the waste toner container 9, dissipating charge of the waste toner to an earth member of the device body 2. This prevents adherence of lots of waste toner floating in the waste toner container 9 to the inner surfaces of the windows of the waste toner deposition chamber 80.

(2) Configuration of Control Unit

Figure 2:
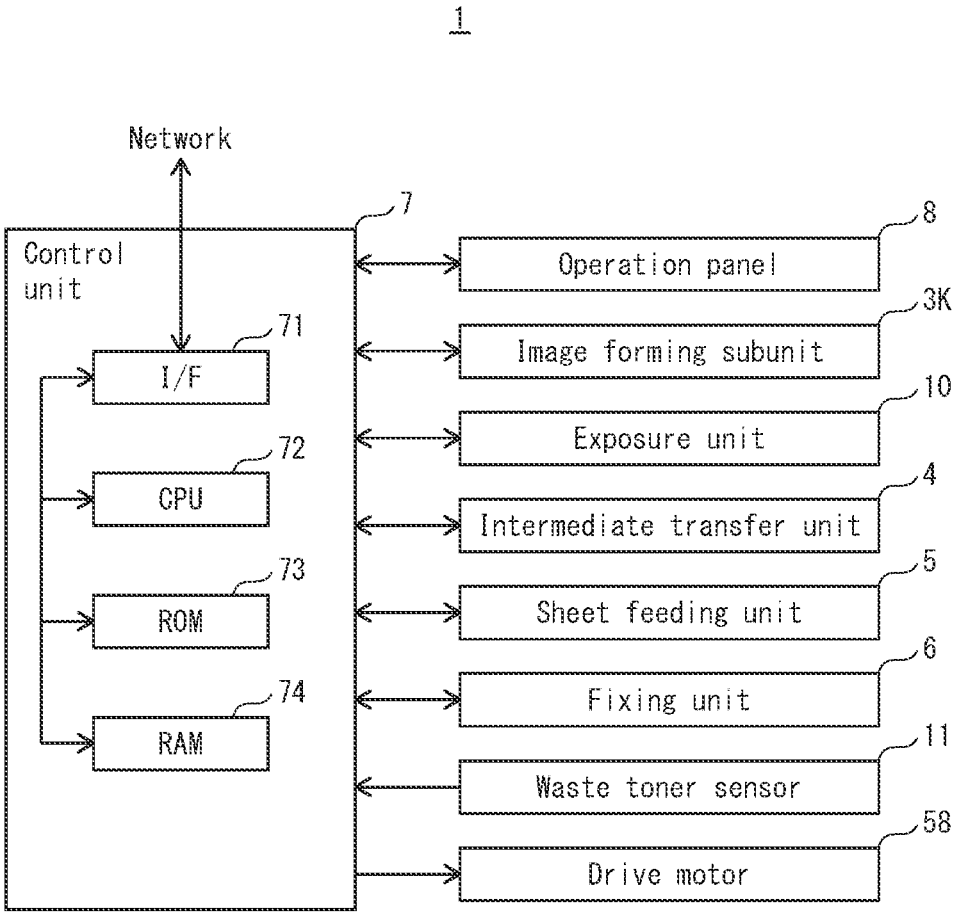
FIG. 2 is a block diagram showing configuration of a control unit provided in the printer.

FIG. 2 is a block diagram showing configuration of the control unit 7.

As shown in the figure, the control unit 7 includes a communication interface (I/F) 71, a CPU 72, a ROM 73, a RAM 74, and so on that can perform mutual communication.

The I/F 71 is an interface such as a LAN card and a LAN board for connection to a network such as LAN, and communicates with an external terminal device that is connected therewith via the network.

The CPU 72 reads a necessary program from the ROM 73, and controls the image forming subunit 3K, the exposure unit 10, the intermediate transfer unit 4, the sheet feeding unit 5, and the fixing unit 6 to smoothly execute a print job. The RAM 74 is used as a work area for the CPU 72.

Further, upon receiving a signal indicating that the waste toner container 9 has become full of waste toner from the waste toner sensor 11, the CPU 72 controls the operation panel 8 to display a warning message that urges replacement of the waste toner container 9.

After replacement of the waste toner container 9 by the user, when no longer receiving the signal, which indicates full of waste toner, the CPU 72 turns off the warning message displayed on the operation panel 8. The CPU 72 may for example be configured as follows. Specifically, when the waste toner sensor 11 senses that the waste toner container 9 has become full of waste toner, the CPU 72 may prohibit execution of a print job while displaying the warning message. After replacement of the waste toner container 9, the CPU 72 may cancel prohibition of execution of the print job to execute the print job.

Moreover, the CPU 72 activates a drive motor 58 for rotating a waste toner conveyance member (described later) that is disposed in the waste toner container 9.

(3) Configuration of Waste Toner Container

Figure 3:
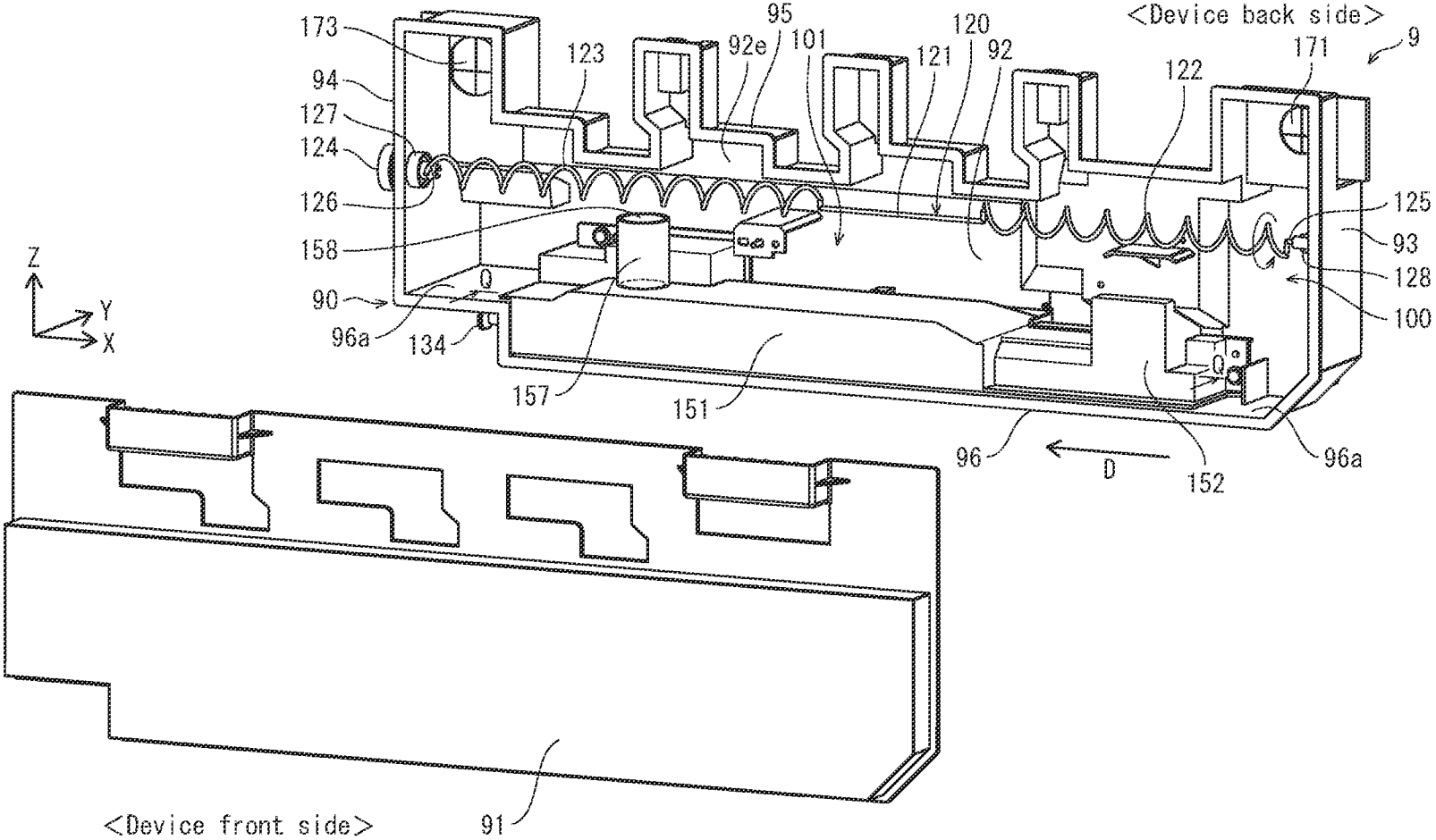
FIG. 3 is an exploded perspective view showing configuration of a waste toner container.

FIG. 3 is an exploded perspective view showing the configuration of the waste toner container 9 that is attached to the device body 2 of the printer 1.

In the figure, the horizontal direction, the longitudinal direction, and the vertical (height) direction when the printer 1 is viewed from a device front side are represented as an X axis, a Y axis, and a Z axis, respectively.

The waste toner container 9 includes a front plate 91, a back plate 92, a right plate 93, a left plate 94, a top plate 95, and a bottom plate 96. The right plate 93 and the left plate 94 connect the front plate 91 and the back plate 92 at their horizontal ends. The top plate 95 and the bottom plate 96 connect the front plate 91 and the back plate 92 at their vertical ends. A space 100 surrounded by the plates 91-96 constitutes an internal space of the waste toner container 9. Note that, among the plates 91-96, the plates except the top plate 95 and the bottom plate 96 are regarded as side surfaces of the waste toner container 9. A case that is constituted from the plates 91-96, which are connected to one another, is hereinafter referred to as a container body 90. Inner surfaces of the plates 91-96 constitute an inner surface of the container body 90.

The container body 90 is made of an insulating resin such as polystyrene (PS) and acrylonitrile-butadiene-styrene (ABS) copolymer synthetic resin. Note that, for the purpose of easy understanding of the internal configuration of the waste toner container 9, only the front plate 91 is removed from the waste toner container 9 in the figure.

On the bottom plate 96, partition covers 151 and 152 are disposed for partitioning the internal space 100 into two containing spaces, namely an upper containing space and a lower containing space.

Figure 4:
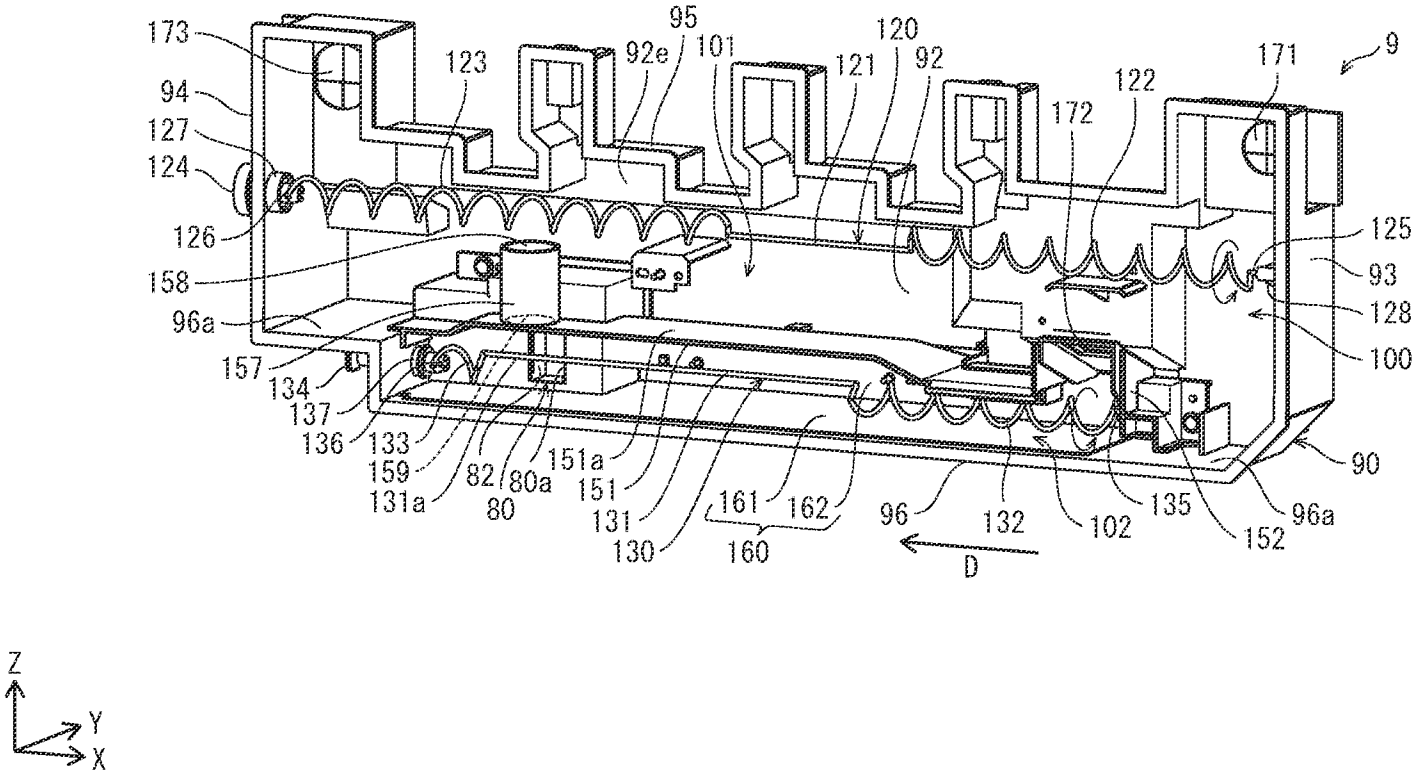
FIG. 4 is a cross-sectional view taken along a line Q-Q in FIG. 3.
Figure 5:
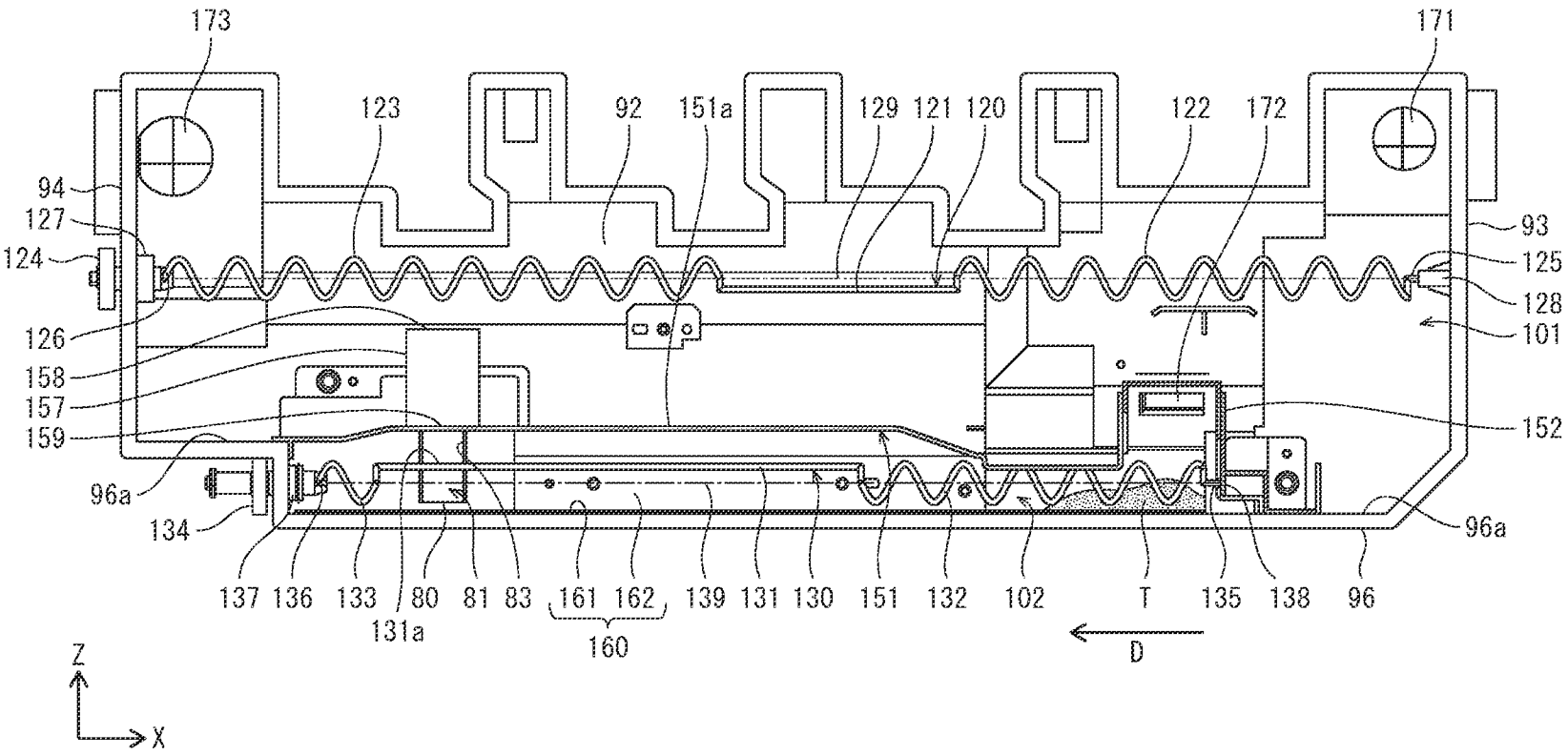
FIG. 5 is a front view showing internal configuration of a container body shown in FIG. 4 viewed from a device front side.

FIG. 4 is a cross-sectional view taken along a line Q-Q in FIG. 3, showing the internal space 100 of the container body 90 that is partitioned into an upper containing space 101 and a lower containing space 102 with the partition covers 151 and 152 therebetween. FIG. 5 is a front view showing the internal configuration of the container body 90 shown in FIG. 4, viewed from the device front side.

As shown in FIG. 4 and FIG. 5, waste toner inlets 171 and 173 are provided at a right upper end and a left upper end of the back plate 92, respectively.

The waste toner inlet 171 receives waste toner discharged from the cleaner 34 of the image forming subunit 3K. The waste toner inlet 173 receives waste toner discharged from the cleaner 47 of the intermediate transfer unit 4.

The waste toner, which has been received through the waste toner inlets 171 and 173 and has entered the upper containing space 101, falls immediately below the waste toner inlets 171 and 173, and is deposited on right and left surfaces 96*a* at the ends of the bottom plate 96. The surfaces 96*a* are not covered with the partition cover 151.

The upper containing space 101 is elongated in the horizontal direction (X axis direction). In the upper containing space 101, a driven-rotary waste toner conveyance member 120 is disposed above in the height direction (Z axis direction).

The waste toner conveyance member 120 is a rotary conveyance member for conveying waste toner, and is made for example of metal such as stainless or resin. The waste toner conveyance member 120 includes two coil units 122 and 123 and a linear stirring rod unit 121 that are integrated together. The coil units 122 and 123 are each a spiral coil. The stirring rod unit 121 is positioned between the coil units 122 and 123, and is parallel to the center line of the rotational axis (rotational axis) 129 (FIG. 5) of the coil units 122 and 123. The stirring rod unit 121 has a radius of rotation that is slightly smaller than those of the coil units 122 and 123.

The coil unit 123 has a shaft 126 integrated therewith at a left end thereof. The shaft 126 is rotatably supported by a bearing 127 that is provided in the left plate 94, and has a portion protruding outward from the container body 90. The protruding portion has attached thereto a gear 124.

The coil unit 122 has a shaft 125 integrated therewith at a right end thereof. The shaft 125 is rotatably supported by a bearing 128 that is provided in the right plate 93. Rotational axes of the shafts 125 and 126 coincide with the rotational axis 129 of the coil units 122 and 123 and the stirring rod unit 121.

In response to transmission of a driving force by the drive motor 58 (FIG. 2), the gear 124 rotates in a constant direction, and thereby the coil units 122 and 123 and the stirring rod unit 121 rotate in the same direction as that of the gear 124. The coil units 122 and 123 are wound (spiraled) oppositely to each other to rotate in the same direction as that of the gear 124, thereby to convey contained waste toner toward the stirring rod unit 121, in other words, thereby to act on the waste toner a conveying force toward the stirring rod unit 121 (in a rotational axis direction). The drive motor 58 is driven to rotate while a print job is executed for example.

As a result of an increase of an amount of waste toner that has been deposited on the surfaces 96*a* immediately below the waste toner inlets 171 and 173, the top of a stack of waste toner reaches the height of the coil units 122 and 123 and thus comes into contact with the coil units 122 and 123 that are rotating. Then, while the stack of waste toner collapses by a force in the rotational axis direction applied from the coil units 122 and 123, the waste toner is conveyed little by little toward the stirring rod unit 121. This configuration levels the stack of waste toner, which have been deposited immediately below the waste toner inlets 171 and 173.

As a result of an increase of an amount of the waste toner, which has been conveyed toward the stirring rod unit 121 and deposited on a surface 151*a* of the partition cover 151 that is immediately below the stirring rod unit 121, the top of the stack of waste toner reaches the height of the stirring rod unit 121 and thus comes into contact with the stirring rod unit 121 that is rotating. Then, the waste toner is stirred by the stirring rod unit 121 by a force in a direction perpendicular to the rotational axis 129 applied from the stirring rod unit 121. In this way, the stirring rod unit 121 is used for stirring waste toner around the rotational axis 129 by applying not a conveyance force in the rotational axis direction but mainly a force in the direction of rotation around the rotational axis 129.

Waste toner is leveled by the coil units 122 and 123 and the stirring rod unit 121 so as to be deposited substantially evenly in the upper containing space 101.

The stirring rod unit 121 is used here as a stirring unit for applying a force of the rotational direction to waste toner. Alternatively, a plate-like paddle may for example be provided in the rotational axis as the stirring unit so as to have a plate surface along the rotational axis.

Further, the coil units 122 and 123 are used here as a spiral part for applying the conveyance force in the rotational axis direction to waste toner. Alternatively, conveyance screws may for example be provided that have spiral blades wound around the rotational axis. A rotary member may convey waste toner by rotating around the rotational axis in the waste toner conveyance direction. The same applies to a stirring rod unit 131, coil units 132 and 133 which are described later.

As a result of a further increase of an amount of waste toner contained in the upper containing space 101, the top of the stack of waste toner reaches an upper opening 158 of a tubular communication member 157 that is provided on the partition cover 151, and the waste toner that is ready to climb over the opening 158 in the height direction falls into the opening 158.

The communication member 157 also has a lower opening 159 that is communicated with the lower containing space 102 via a through-hole (not shown) provided in the partition cover 151. This allows the waste toner, which has entered the inside of the communication member 157 through the upper opening 158, to pass through the communication member 157 thereby to fall in the lower containing space 102. The upper containing space 101 and the lower containing space 102 are only partially communicated with each other via the communication member 157 (communication member) in this way because of the following reason.

Specifically, in the present embodiment, a sensing mechanism is provided for the lower containing space 102 in order to sense full of waste toner. Meanwhile, such a sensing mechanism is not provided for the upper containing space 101. In the present embodiment as described above, although monochrome images of only the K color are formed, the waste toner container 9 is used, which has the same size as that for formation of color images of the Y, C, M, and K colors. This leaves a larger room in the upper containing space 101 than necessary. Thus, in terms of design, the upper containing space 101 does not become full of waste toner unless the lower containing space 102, which is narrower than the upper containing space 101, has become full of waste toner.

However, even based on the above assumption in terms of design, there might be a possibility that the upper containing space 101 becomes full of waste toner before the lower containing space 102 has become full of waste toner, depending on the usage environment of the printer 1. Even when such a rare case occurs, it is possible to sense full of waste toner in the upper containing space 101 by enabling transmission of waste toner from the upper containing space 101 to the lower containing space 102 via the communication member 157. For this reason, the upper containing space 101 and the lower containing space 102 are only partially communicated with each other via the communication member 157. The waste toner deposition chamber 80 has an opening 80*a* immediately below the communication member 157. Waste toner, which has passed through the communication member 157 and fallen in the lower containing space 102, enters the waste toner deposition chamber 80 through the opening 80*a*, and is sensed by the waste toner sensor 11.

The lower containing space 102 has a smaller capacity for waste toner than the upper containing space 101, and is elongated in the horizontal direction (X axis direction). The lower containing space 102 is communicated, at a position of a right end thereof slightly below the partition cover 152, with a waste toner inlet 172 that is provided in the back plate 92.

The waste toner inlet 172 is an inlet for receiving waste toner discharged from the developing unit 33 according to the trickle development system.

Although the lower containing space 102 is communicated with the upper containing space 101 via the communication member 157, waste toner contained in the upper containing space 101 is rarely conveyed to the lower containing space 102, as described above. In view of this, the lower containing space 102 is regarded basically as a space for containing waste toner discharged from the developing unit 33.

In the lower containing space 102, a driven-rotary waste toner conveyance member 130 is disposed above in the height direction (Z axis direction).

Like the waste toner conveyance member 120, the waste toner conveyance member 130 is a rotary conveyance member for conveying waste toner, and is made for example of metal such as stainless or resin. The waste toner conveyance member 130 includes two coil units 132 and 133 and a linear stirring rod unit 131 that are integrated together. The coil units 132 and 133 are each a spiral coil. The stirring rod unit 131 is positioned between the coil units 132 and 133, and is parallel to rotational axes 139 of the coil units 132 and 133. The stirring rod unit 131 has a radius of rotation that is slightly smaller those that of the coil units 132 and 133.

The coil unit 133 has a shaft 136 integrated therewith at a left end thereof. The shaft 136 is rotatably supported by a bearing 137 that is provided in the left plate 94, and has a portion protruding outward from the container body 90. The protruding portion has attached thereto a gear 134.

The coil unit 132 has a shaft 135 integrated therewith at a right end thereof. The shaft 135 is rotatably supported by a bearing 138 that is provided in the partition cover 152. Rotational axes of the shafts 135 and 136 coincide with the rotational axes 139 of the coil units 132 and 133 and the stirring rod unit 131.

In response to transmission of a driving force by the drive motor 58, the gear 134 rotates in a constant direction in the same manner as the gear 124, and thereby the coil units 132 and 133 and the stirring rod unit 131 rotate in the same direction as that of the gear 134. The coil units 132 and 133 are wound (spiraled) oppositely to each other to rotate in the same direction as that of the gear 134, thereby to act on waste toner a conveying force toward the stirring rod unit 131.

As a result of an increase of an amount of waste toner T deposited on a surface immediately below the waste toner inlet 172, the top of the stack of waste toner T reaches the height of the coil unit 132 and thus comes into contact with the coil unit 132 that is rotating. Then, while the stack of waste toner T collapses by a force in the rotational axis direction applied from the coil unit 132, the waste toner T is conveyed little by little toward the stirring rod unit 131 (direction indicated by an arrow D). This configuration levels the stack of waste toner T, which has been deposited immediately below the waste toner inlet 172.

As a result of an increase of the amount of the waste toner T, which has been conveyed in the direction indicated by the arrow D (leftwards) and deposited on a surface that is immediately below the stirring rod unit 131, the top of the stack of waste toner T reaches the height of the stirring rod unit 131 and thus comes into contact with the stirring rod unit 131 that is rotating Then, the waste toner T is stirred by the stirring rod unit 131 by a conveying force in the direction of rotation around the rotational axis 129 applied from the stirring rod unit 131.

The waste toner T enters the lower containing space 102 little by little through the waste toner inlet 172. This results in an increase of an accumulated amount of the waste toner T contained in the lower containing space 102. Then, the waste toner T is conveyed by the coil unit 132 little by little toward the left end of the lower containing space 102 while the waste toner T is stirred by the stirring rod unit 131.

The back plate 92 has provided thereon the waste toner deposition chamber 80 at a position facing a part 131*a* that is close to the left end of the stirring rod unit 131. The waste toner deposition chamber 80 protrudes from the back plate 92 toward the device back side.

The waste toner deposition chamber 80 is a box that is made of a light-transmissive material, specifically a transparent resin here. The waste toner deposition chamber 80 has the opening 80*a* on the device front side, and has a sensing space 81 that is communicated with the lower containing space 102 via the opening 80*a*. The sensing space 81 is a space where contained waste toner T enters.

When the waste toner T reaches a position of the waste toner deposition chamber 80 while being conveyed leftwards in the lower containing space 102, the toner gradually enters the sensing space 81 of the waste toner deposition chamber 80. As a result, the waste toner T is increasingly deposited in the toner deposit chamber 80. Note that the coil unit 133, which is positioned on the left end side, reversely conveys the waste toner T, which has been conveyed to the left end after passing through the waste toner deposition chamber 80, rightwards (direction indicated by an arrow X) so as to be returned to the position of the waste toner deposition chamber 80.

As a result of a further increase of the amount of waste toner T contained in the lower containing space 102, the top of the stack of waste toner T deposited in the waste toner deposition chamber 80 reaches a certain height. Then, the optical waste toner sensor 11 senses that the lower containing space 102 has become full of the waste toner T. A specific method of this sensing is described later.

Figure 6:
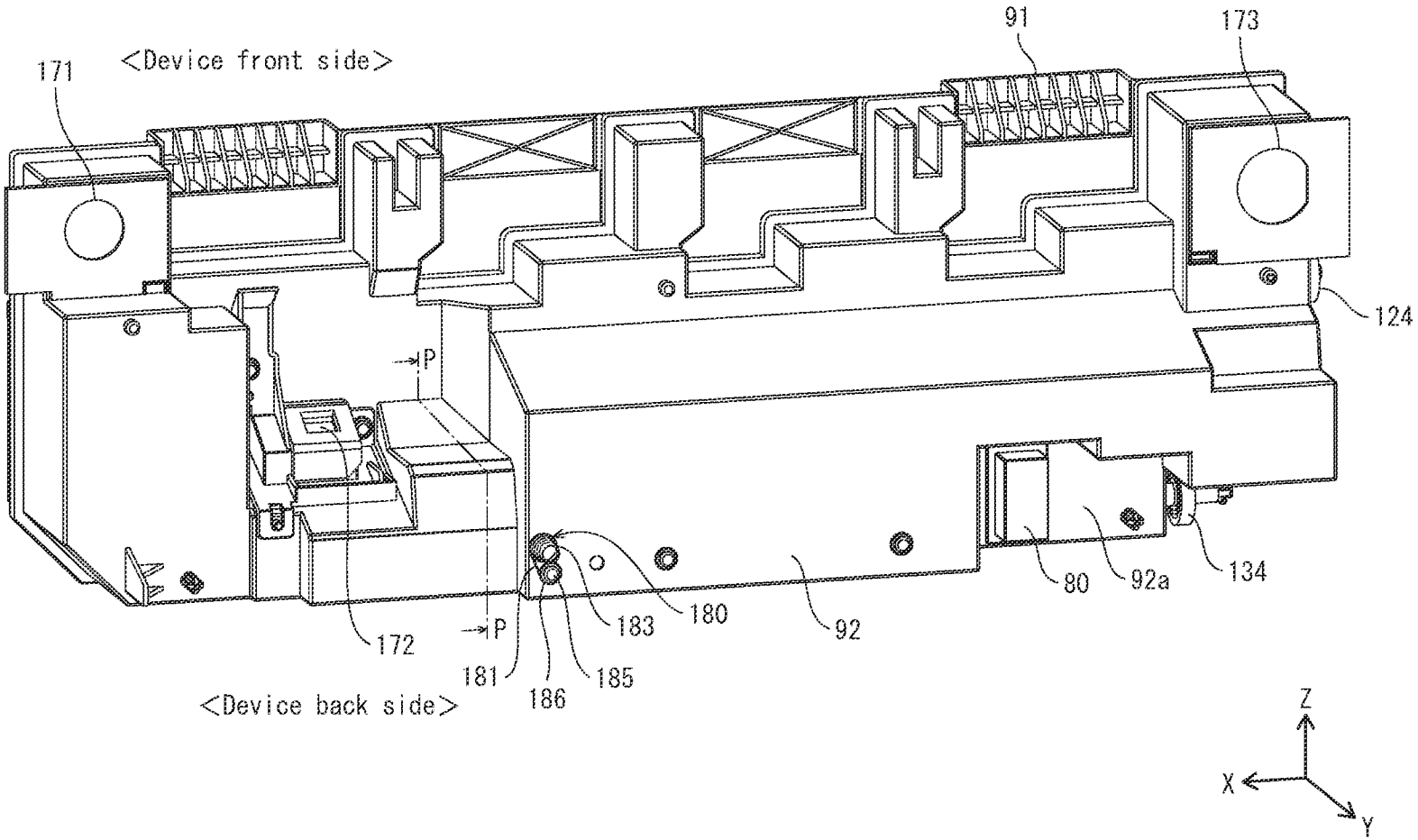
FIG. 6 is a perspective view showing the waste toner container viewed from a device back side.

FIG. 6 is a perspective view showing the waste toner container 9 viewed from the device back side.

As shown in the figure, the waste toner container 9 has the waste toner inlets 171 and 173 provided at respective upper parts of the both ends in the horizontal direction of the back plate 92, and has the waste toner inlet 172 provided at a lower right diagonal position relative to the waste toner inlet 171 when viewed from the device back side.

The waste toner container 9 has, on a lower part of the back plate 92, the waste toner deposition chamber 80 at a lower left diagonal position relative to the waste toner inlet 173 when viewed from the device back side. The waste toner deposition chamber 80 protrudes from an outer surface 92*a* of the back plate 92 toward the device back side (direction indicated by an arrow Y).

Further, a coil spring 180 is fixed with a screw 185 to a lower right diagonal position relative to the waste toner inlet 172 on the outer surface 92*a* of the back plate 92. Specifically, the coil spring 180 is fixed to the back plate 92 by fastening the screw 185 while one end part 181 of the coil spring 180 is sandwiched between a head part 186 of the screw 185 and the outer surface 92*a* of the back plate 92 with a central axis of the coil unit 183 of the coil spring 180 along the Y axis (with the coil unit 183 standing on the outer surface 92*a*).

The coil spring 180 is made of metal such as copper and stainless. The screw 185 is also made of metal such as brass and iron. The coil spring 180 and the screw 185 are both conductive.

While the waste toner container 9 is attached to the device body 2, the coil spring 180 is electrically connected to a frame 20 (FIG. 11) functioning as an earth member provided in the device body 2. The reason for provision of the coil spring 180 is described later.

(4) Configuration of Waste Toner Sensor

Figure 7:
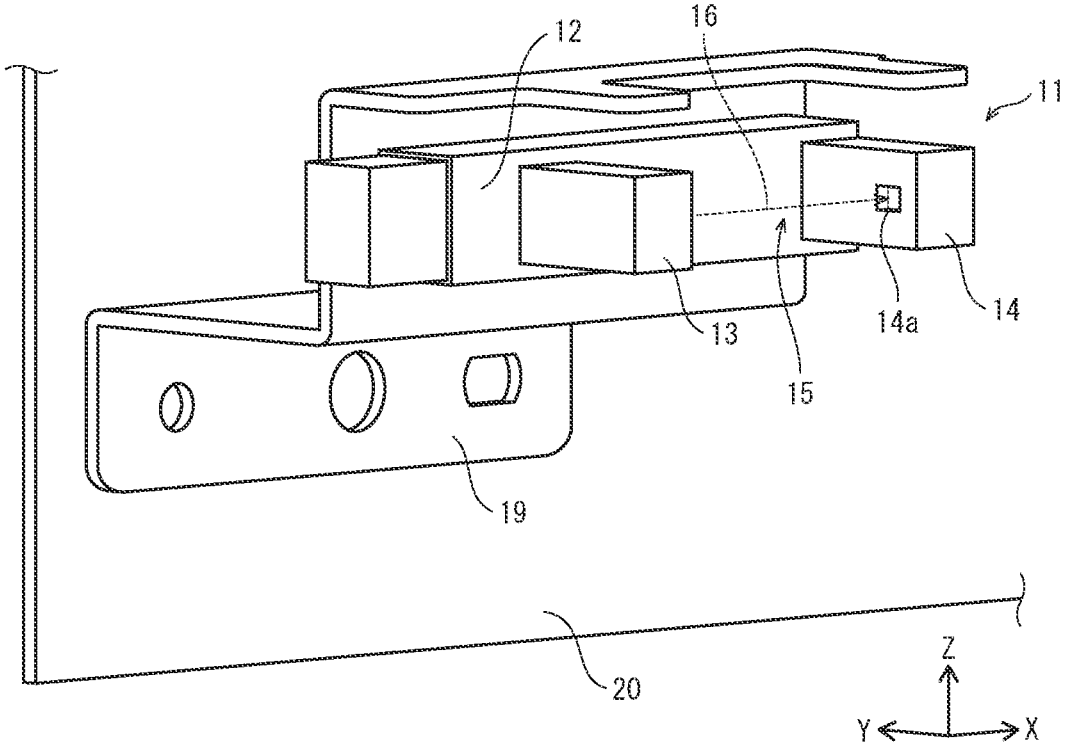
FIG. 7 is a schematic perspective view showing configuration of a waste toner sensor.

FIG. 7 is a schematic perspective view showing the configuration of the waste toner sensor 11.

As shown in the figure, the waste toner sensor 11 includes a body 12, a light-emitting unit 13, and a light receiving unit 14. The waste toner sensor 11 is fixed to the frame 20 of the device body 2 via an attachment plate 19.

The light-emitting unit 13 and the light receiving unit 14 face each other with a space 15 therebetween. When sensing light 16 (indicated by a dashed line), which has been emitted toward the light receiving unit 14 from the light-emitting unit 13, is received on a light receiving surface 14*a* of the light receiving unit 14, the body 12 outputs a signal corresponding to a received light amount to the control unit 7. Here, the greater the received light amount is, the greater the value of the signal is.

The control unit 7 judges whether or not the waste toner container 9 has become full of waste toner in accordance with the value of the signal output from the waste toner sensor 11. Specifically, when the value of the signal output from the waste toner sensor 11 is equal to or greater than a threshold value, the control unit 7 judges that the waste toner container 9 has not yet become full of waste toner. When the value of the signal is less than the threshold value, the control unit 7 judges that the waste toner container 9 has become full of waste toner.

Figure 8:
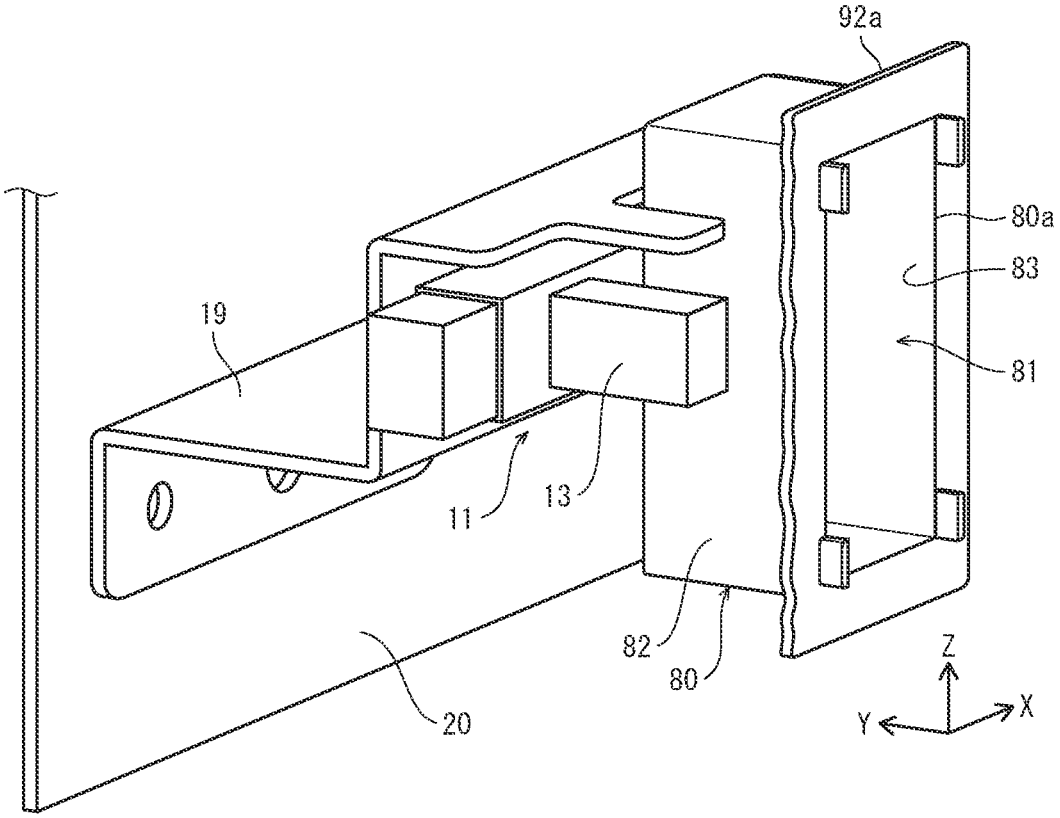
FIG. 8 is a perspective view showing the waste toner container that is attached to a device body.

FIG. 8 is a perspective view showing a state where while the waste toner container 9 is attached to the device body 2, the waste toner deposition chamber 80 of the waste toner container 9 is disposed in the space 15 between the light-emitting unit 13 and the light receiving unit 14 of the waste toner sensor 11.

The waste toner deposition chamber 80 is a box that has the opening 80*a* on the device front side and is made of a transparent resin. This allows the sensing light 16, which has been emitted from the light-emitting unit 13 of the waste toner sensor 11, to transmit through side walls 82 and 83 of the waste toner deposition chamber 80. The side walls 82 and 83 function as light-transmissive windows through which an amount of deposited waste toner is optically monitorable from the outside of the container body 90.

When waste toner is not deposited so much in the waste toner deposition chamber 80, most part of the sensing light 16 emitted from the light-emitting unit 13 transmits through the windows 82 and 83 and then is received by the light receiving unit 14. At this time, the value of the signal output from the waste toner sensor 11 is equal to or greater than the threshold value.

On the other hand, when the amount of waste toner deposited in the waste toner deposition chamber 80 increases and the top of the stack of deposited waste toner reaches the height of the sensing light 16 emitted from the light-emitting unit 13 (a certain height), the sensing light 16 is shielded by the stack of deposited waste toner. This makes the sensing light 16 impossible to transmit through the window 83. Due to this, the light receiving unit 14 cannot receive most of the sensing light 16. At this time, the value of the signal output from the waste toner sensor 11 is less than the threshold value, and accordingly the control unit 7 judges that the waste toner container 9 has become full of waste toner.

(5) Frictional Charging of Waste Toner

The above has explained the state where waste toner is sensed in the normal condition. As explained in Summary, there is a tendency that in the case where waste toner is continuously stirred by the stirring rod unit 131 while being conveyed in the lower containing space 102 by the coil units 132 and 133, lots of particles of the waste toner being conveyed float in the lower containing space 102 while being frictionally charged. This frictional charging is caused by contact with the bottom plate 96, the back plate 92, and so on of the container body 90.

Waste toner floating while being frictionally charged enters the waste toner deposition chamber 80, and continuously adheres to inner surfaces of the windows 82 and 83 by the action of an electrostatic force. Then, when an amount of the adhered waste toner increases to an extent that the sensing light 16 is shielded by the adhered waste toner, the waste toner sensor 11 erroneously senses that the lower containing space 102 has become full of waste toner though the lower containing space 102 has not yet actually become full of waste toner.

Especially in the case where toner having a larger charge amount is used due to an increased printing speed as described above, the toner adheres to the inner surfaces of the windows 82 and 83 with a stronger adhesion force. Further, toner discharged from the developing unit 33 according to the trickle development system is less deteriorated than toner that is mechanically scraped after transfer from the photosensitive drum 31 and the intermediate transfer belt 41 by the cleaners 34 and 47. Accordingly, the discharged toner is often maintained with high electrostatic properties, and thus easily adheres to the windows 82 and 83.

In the present embodiment, in order to prevent such an erroneous sensing, a mechanism for dissipating charge of waste toner which has been frictionally charged is provided both in the waste toner container 9 and the device body 2.

(6) Mechanism for Dissipating Charge of Waste Toner

Figure 9:
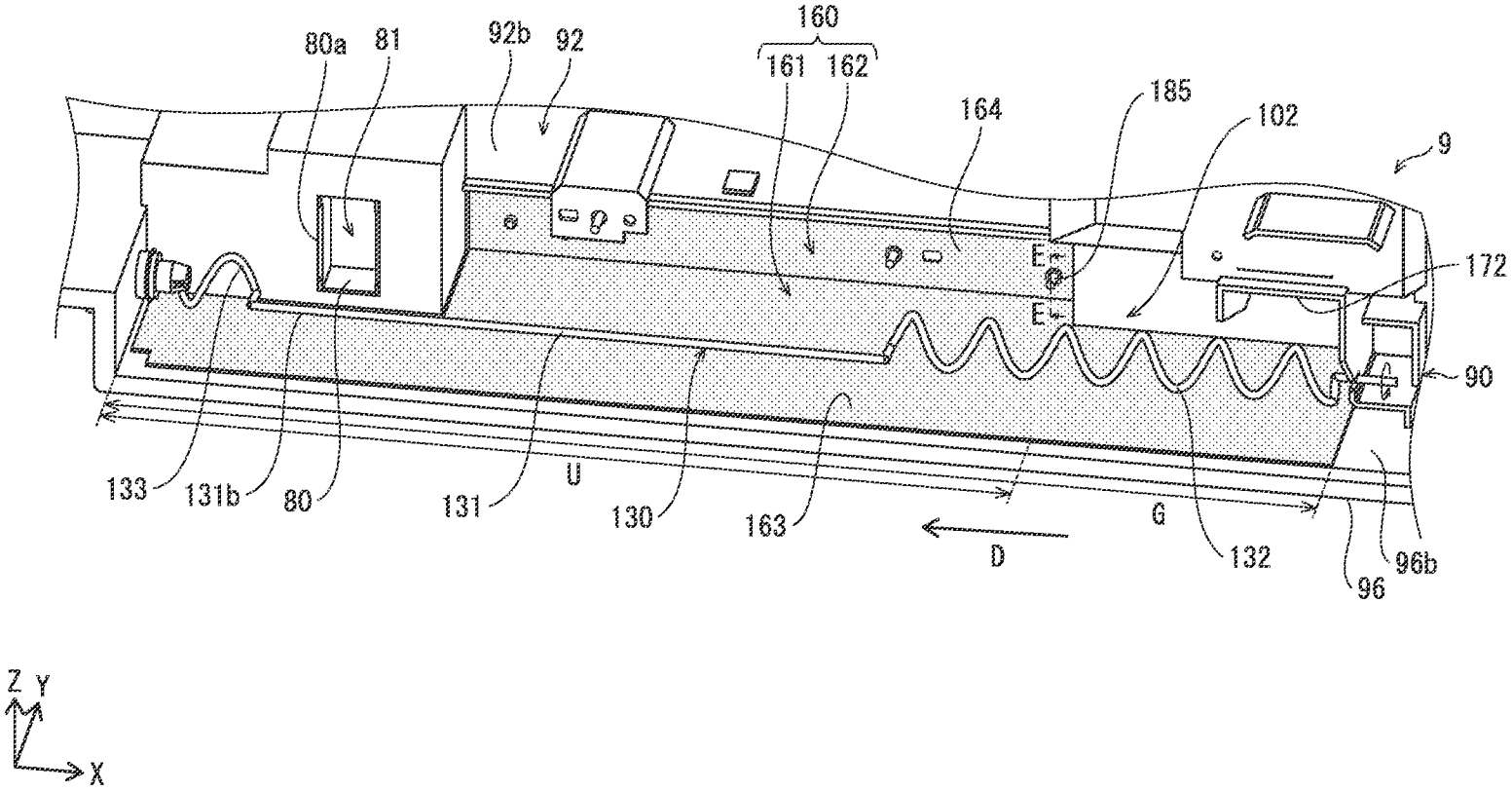
FIG. 9 is a perspective view for explaining a mechanism for dissipating charge of waste toner.

FIG. 9 is a perspective view for explaining the mechanism for dissipating charge of waste toner, showing a configuration example in which a sheet-shaped conductive member 160 is disposed on the bottom plate 96 and the back plate 92 that face the lower containing space 102 of the container body 90. Note that the conductive member 160 is represented by halftone dots in the figure. This is in order to distinguish the conductive member 160 from other members, and thus representation by halftone dots does not have special meaning.

The conductive member 160 is made for example of metal such as aluminum, iron, and copper. The conductive member 160 includes a first conductive part 161 and a second conductive part 162 that are provided on an inner surface of the container body 90. Specifically, the first conductive part 161 is disposed on a container bottom surface 96*b* of the bottom plate 96, and the second conductive part 162 is disposed on a container side surface 92*b* of the back plate 92. The conductive member 160 is bent to an L-shape.

The first conductive part 161 is provided on substantially the entire bottom plate 96 from one end to the other end in the horizontal direction of the lower containing space 102. Most of waste toner contained in the lower containing space 102 is deposited on an upper surface 163 of the first conductive part 161.

The second conductive part 162 is mainly provided on the back plate 92 to face the stirring rod unit 131 (stirring unit) of the waste toner conveyance member 130. The second conductive part 162 has an inner surface 164 facing the lower containing space 102. The first conductive part 161 and the second conductive part 162 are both disposed along a waste toner conveyance area where the waste toner conveyance member 130 conveys waste toner.

The first conductive part 161 is fixed to the bottom plate 96 with an adhesive or the like, and the second conductive part 162 is fixed to the back plate 92 at a plurality of positions with screws. One of the screws fixing the second conductive part 162 to the back plate 92 doubles as the screw 185 fixing the coil spring 180 to the back plate 92.

Figure 10:
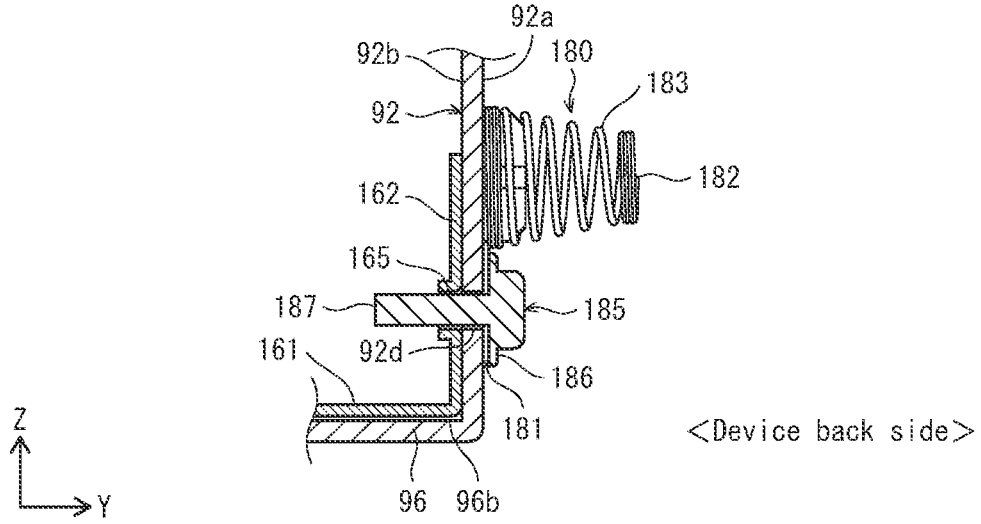
FIG. 10 is a cross-sectional view taken along a line E-E in FIG. 9.

FIG. 10 is a cross-sectional view taken along a line E-E in FIG. 9, showing configuration of fixing by the screw 185.

As shown in FIG. 10, the back plate 92 has a through-hole 92*d* for screw fixing, and the second conductive part 162 has a hole 165 for screw fixing. The through-hole 92*d* has a diameter slightly greater than a diameter of a shaft 187 of the screw 185. The hole 165 has a groove in its inner surface. The shaft 187 of the screw 185 engages with this groove. The shaft 187 of the screw 185 engages with the hole 165 of the second conductive part 162 through the through-hole 92*d* of the back plate 92 from the device back side. This allows fixing of the second conductive part 162 with the screw 185.

In this screw fixing, the coil spring 180 is fixed to the back plate 92 by sandwiching of the one end part 181 of the coil spring 180 between the head part 186 of the screw 185 and the outer surface 92*a* of the back plate 92.

As described above, the coil spring 180 and the screw 185 are both conductive and directly contact each other. Furthermore, the screw 185 and the second conductive part 162 directly contact each other. Accordingly, the second conductive part 162 and the coil spring 180 are electrically connected with each other via the screw 185. Since the conductive member 160, the screw 185, and the coil spring 180 are each a good conductor whose electrical resistance is extremely low, the conductive member 160 and the coil spring 180 are nearly in a direct contact with each other.

Figure 11:
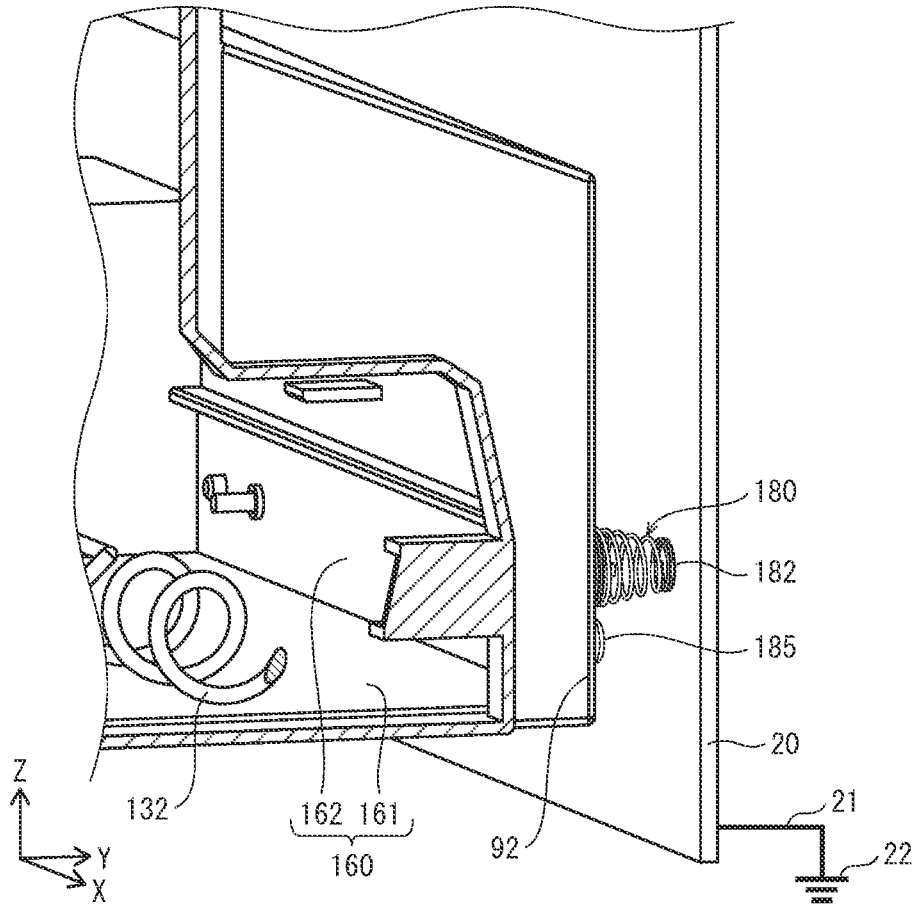
FIG. 11 is a perspective view showing a state where while the waste toner container is attached to the device body, a coil spring of the waste toner container is brought into contact with a frame of the device body, including a partial cross-sectional view.

FIG. 11 is a perspective view showing a state where while the waste toner container 9 is attached to the device body 2, a tip part 182 of the coil spring 180 of the waste toner container 9 is brought into contact with the frame 20 of the device body 2, including a partial cross-sectional view taken along a line P-P in FIG. 6.

As shown in FIG. 11, while the waste toner container 9 is attached to the device body 2, the coil spring 180 of the waste toner container 9 has a restoring force because of being compressed slightly more strongly than before attachment. By the action of this restoring force, the tip part 182 of the coil spring 180 is pressed onto a surface of the frame 20 of the device body 2. This surely maintains a contact state between the coil spring 180 and the frame 20.

The frame 20 of the device body 2 is a good conductor made of a conductive metal such as stainless, and is earthed to a ground 22 via an earth line 21.

Accordingly, while the waste toner container 9 is attached to the device body 2, the conductive member 160 is electrically earthed to the ground 22 via the screw 185, the coil spring 180, the frame 20, and the earth line 21.

Waste toner enters the lower containing space 102 through the waste toner inlet 172 of the waste toner container 9, and is conveyed by the waste toner conveyance member 130 while coming into contact with the conductive member 160. The conductive member 160 is earthed on the side of the device body 2. Owing to this, even when waste toner is frictionally charged while being conveyed, charge of the waste toner easily dissipates from the conductive member 160, which is in contact with a surface of the waste toner, to the ground 22 of the device body 2. As a result, it is possible to reduce a charge amount of the waste toner.

The inventor prepared three waste toner containers as comparative examples 1 and 2 and an example, and conducted an experiment for comparing amount of waste toner adhered to the windows of the waste toner deposition chamber 80.

Here, the comparative example 1 has configuration in which no conductive member is disposed, the comparative example 2 has configuration in which the conductive member 160 is disposed but is not earthed, and the example has configuration in which the conductive member 160 is disposed and is earthed.

The container body is made of PS resin, the waste toner conveyance member is made of stainless, the conductive member is a copper tape, and the frame of the device body is made of stainless.

The experiment was conducted in the same conditions for the comparative examples 1 and 2 and the example. Specifically, under an environment at normal temperature (20° C.) and humidity (65%), while the waste toner container was attached to the printer, the waste toner conveyance member was rotated at 43 rpm for a constant time period during which waste toner was filled little by little from the waste toner inlet 172. Note that the toner used here has a charge amount larger than conventional ones due to an increased printing speed. Specifically, in the case where printing is sequentially performed on 1200K (K indicates 1000) sheets piece by piece, conventional toner in a developing unit has a charge amount Qb of approximately 30-40 μC/g. Compared with this, the toner used in the experiment has a charge amount Qb of approximately 36-50 μC/g.

At the end of the experiment, visual check was performed on the amount of waste toner adhered to the windows of the waste toner deposition chamber 80. Further, surface potential (kV) of waste toner contained in the waste toner container was measured with measuring equipment.

It was observed that, in each of the comparative examples 1 and 2, a surface potential of waste toner is approximately 1-2 kV, and an amount of waste toner is adhered to inner surfaces of the windows to an extent that sensing light is shielded.

Compared with this, it was observed that, in the example, a surface potential of waste toner is decreased to approximately 0.1-0.2 kV, and that only a small amount of waste toner is adhered to the inner surfaces of the windows to an extent that sensing light is not shielded. The following consideration is derived from the above. In the example, charge of waste toner dissipated to the ground. Accordingly, compared with the comparative examples 1 and 2, the waste toner had a less amount of accumulated charge and thus had a decreased surface charge. This suppressed adherence of waste toner to the inner surfaces of the windows by the action of an electrostatic force.

In the present embodiment as described above, the mechanism is provided for dissipating charge of waste toner contained in the lower containing space 102 from the conductive member 160 to the ground of the device body 2. Accordingly, compared with a configuration in which no mechanism for earthing a conductive member is provided, it is possible to reduce an amount of charge of waste toner resulting from frictionally charging of the waste toner during conveyance. This suppresses adherence of waste toner floating in the lower containing space 102 to the inner surfaces of the light-transmissive windows of the waste toner deposition chamber, thereby reducing erroneous sensing performed by the waste toner sensor 11 due to adherence of lots of waste toner to the inner surfaces of the windows.

Note that, in the above, the members for dissipating charge of waste toner to the ground 22, namely the conductive member 160, the screw 185, the coil spring 180, the frame 20, and the earth line 21, are each a good conductor that is configured to have an electrical resistance as small as possible in the case where these members are connected in serial. Alternatively, these members only need to have an electrical resistance according to which charge of waste toner can be dissipated. In the case for example where the members excepting the conductive member 160 are each a good conductor, the conductive member 160 may be made of a material having resistance of $10^{12}$ Ω or less.

<Modifications>

Although the present invention has been explained based on the embodiment, the present invention is not of course limited to the above embodiment. The present invention may include the following modifications.

(1) In the above embodiment, the configuration example has been explained in which the conductive member 160 is disposed on the inner surface (container bottom surface) 96*b* of the bottom plate 96 and on the inner surface (container side surface) 92*b* of the back plate 92 of the waste toner container 9. However, the present invention is not limited to this. For example, the conductive member may be provided on at least one of the bottom surface and the side surface included in the inner surface of the container body 90. Alternatively, a metal conductive sheet that is different from the conductive member 160 may be pasted onto the inner surface (container side surface) of the front plate 91 or (/and) a lower surface of the partition cover 151 such that the conductive sheet is earthed by being electrically connected to the conductive member 160 or the coil spring 180 via an electric wire or the like.

Also, the example has been explained in which the conductive member 160 is composed of one side across a fold line of a single twofold sheet as the first conductive part 161 and the other side of the twofold sheet as the second conductive part 162. However, the present invention is not limited to this. For example, the first conductive part 161 and the second conductive part 162 may be provided separately as a first conductive member 160 and a second conductive member 160, respectively, so as to be earthed separately. Alternatively, the first conductive member 160 may be earthed by the screw 185 and the coil spring 180, and the second conductive member 160 may be electrically connected to the first conductive member 160 by an electric wire or the like. The following configurations are included in configuration in which for example at least part of the conductive member is provided on the container bottom surface 96*b*: configuration in which a single conductive member is provided only on the container bottom surface 96*b*; configuration in which part of the conductive member is provided on the container bottom surface 96*b* and remaining part of the conductive member is provided on the container side surface 92*b*, and the like.

In this way, the conductive member is provided at a position on the inner surface of the container body 90 where the conductive member comes into contact with waste toner that is being conveyed by the waste toner conveyance member 130.

(2) Also, the configuration example of the conductive member 160 has been explained in which the first conductive part 161 is longer than the second conductive part 162 in terms of the entire length from the one end to the other end in the horizontal direction of the lower containing space 102. However, the present invention is not limited to this configuration. The conductive member 160 should desirably be disposed in an area that is at least close to the waste toner deposition chamber 80 in a waste toner conveyance area G (FIG. 9) where the waste toner conveyance member 130 conveys waste toner.

For example, the first conductive part 161 may be disposed only in a partial area U in FIG. 9 of the waste toner conveyance area G Further, the partial area U faces the stirring rod unit 131 (stirring unit) of the waste toner conveyance member 130, and the first conductive part 161 is disposed in this partial area U. According to this, when waste toner is frictionally charged while being stirred by the stirring rod unit 131, it is possible to dissipate charge of the waste toner to the ground.

(3) Moreover, even when waste toner adheres to the windows 82 and 83 of the waste toner deposition chamber 80, the waste toner sensor 11 does not erroneously sense the full of waste toner as long as the total amount of the adhered waste toner is small to an extent that the adhered waste toner does not shield the sensing light of the waste toner sensor 11 till the waste toner container 9 has actually become full of waste toner.

In view of this, in order to suppress the amount of adhered waste toner to this extent or less, the size, disposition, material, and so on of the conductive member 160 can be preliminary determined based on experiments and the like. For example, the conductive member 160 may include only one of the first conductive part 161 and the second conductive part 162.

(4) In the above embodiment, the waste toner deposition chamber 80 is positioned immediately below the communication member 157. However, the present invention is not limited to this. For example, the waste toner deposition chamber 80 may be positioned slightly distant from the position that is immediately below the communication member 157. Also, in the above embodiment, the lower containing space 102 has a smaller capacity than the upper containing space 101. However, the present invention is not limited to this. For example, the containing spaces 101 and 102 may have the same capacity, or the lower containing space 102 may have a larger capacity than the upper containing space 101.

(5) In the above embodiment, the configuration example has been explained in which the conductive member 160 should preferably be sheet-like. However, the present invention is not limited to this. The shape of the conductive member is not limited as long as the conductive member is disposed so as to come into contact with waste toner while being conveyed. For example, an elongated laminated sheet metal, a rod-shaped metal member, or the like may be used as the conductive member.

Specifically, the sheet metal may for example be disposed as the conductive member on the inner surface of the container body 90 of the waste toner container 9. More specifically, the sheet metal may be disposed on at least one of the container bottom surface 96*b* and the container side surface 92*b*. In the case where the sheet metal is disposed on each of both of the container bottom surface 96*b* and the container side surface 92*b*, both the sheet metals may be earthed, or one of the sheet metals may be earthed and the other sheet metal may be electrically connected to the one sheet metal.

Also, the sheet metal or the rod-shaped member for example may be disposed as the conductive member in the lower containing space 102 so as to be in out of contact with the waste toner conveyance member 130 (rotary conveyance member) and be parallel to the waste toner conveyance member 130 along the axial direction of the waste toner conveyance member 130. Alternatively, the sheet metal or the rod-shaped member may be disposed in a direction intersecting with the axial direction (for example, a direction perpendicular to the axial direction). Further, the sheet metal or the rod-shaped member may be disposed in plural number.

(6) In the above embodiment, the configuration example has been explained in which the metal the screw 185 is used as a member for electrically connecting the conductive member 160 with the coil spring 180. However, this member is not limited to a screw. For example, a metal electric wire may be used.

Also, the configuration example has been explained in which the coil spring 180 and the screw 185 are used as a connection unit for electrically connecting the conductive member 160 with the frame 20 (earth member). However, the present invention is not limited to this.

Any connection unit may be used as long as the connection unit penetrates outward from the inside of the container body 90 and is disposed between the conductive member 160, which is provided on the inner surface of the container body 90, and the earth member 20 of the printer (image forming apparatus) 1 outside the container body 90 so as to electrically connect the conductive member 160 with the earth member 20. Specifically, the connection unit may include a first connection part that is electrically connected with the conductive member 160 and a second connection part that is electrically connected with the earth member of the image forming apparatus.

In the example, the connection unit includes the screw 185 as the first connection part and the coil spring 180 as the second connection part.

Further, instead of the configuration in which the coil spring 180 is fixed with the screw 185, assume configuration for example where, the one end part 181 of the conductive coil spring 180 extends into the inside of the container body 90 through the through-hole 92*d* of the back plate 92 such that the one end part 181 is directly electrically connected with the conductive member 160. In this configuration, the coil spring 180 functions as the connection unit, and includes the end part 181 as the first connection part and the coil part 183 as the second connection part.

(7) In the above embodiment, the configuration example has been explained in which while the waste toner container 9 is attached to the device body 2, the coil spring 180 of the waste toner container 9 comes into contact with the frame 20 functioning as the earth member of the device body 2. However, a member that comes into contact with the earth member is not limited to a coil spring as long as the member is elastic. For example, elastic plate-like terminals may be used. Alternatively, the terminals are not limited to be elastic. For example, the following configuration may be employed in which a conductive terminal is convex, the frame 20 has provided therein a concave receiving part into which this convex terminal is fitted, and the convex terminal and the concave receiving part are electrically connected with each other by being engaged with each other. Any configuration may be employed as long as electrical connection is established.

(8) In the above embodiment, the configuration example has been explained in which the rotation driving force of the waste toner conveyance member 130 is transmitted from the drive motor 58 of the device body 2 via the gear 134 (transmission member). However, the present invention is not limited to this. For example, the waste toner container 9 may have provided therein a driving unit such as a drive motor. Further, the transmission member is not limited to a gear, and may for example be a belt.

(9) In the above embodiment, the configuration example has been explained in which the containing space 100 of the container body 90 is partitioned into the two containing spaces, namely, the upper containing space 101 and the lower containing space 102. However, the present invention is not limited to this. For example, in configuration in which toner is contained in the single containing space 100 instead of the configuration in which the internal space is partitioned into two partial containing spaces, the waste toner deposition chamber 80 may be provided at an upper position 92*e* (FIG. 3) that is substantially the center in the horizontal direction of the back plate 92. Even with this configuration, it is possible to dispose the conductive member 160 on the inner surface of the container body 90, for example on substantially the entire area of the container side surface 92*b* and on the container bottom surface 96*b*.

(10) In the above embodiment, the configuration example has been explained in which a monochrome printer employing the trickle development system is used as an image forming apparatus. However, the present invention is not limited to this. The present invention is also applicable to a color printer capable of forming color images. Further, the present invention is applicable to a general development system (in which a developer including toner is not discharged from a developing unit), which is different from the trickle development system. In this case, no waste toner is discharged from the developing unit 33. Accordingly, only waste toner removed by the cleaner 34 is discharged from the image forming subunit 3K, and is contained in the waste toner container 9. Moreover, the present invention is applicable to a general image forming apparatus such as a copy machine, a facsimile device, and a multiple function peripheral (MFP), without being limited to printers.

In other words, the present invention is applicable to an image forming apparatus including the waste toner container 9 containing therein waste toner that is not used for image formation, and is also applicable to the waste toner container 9 that is detachable from the device body 2 of the image forming apparatus. Further, the waste toner container 9 does not need to be detachable from the device body 2 of the image forming apparatus.

Moreover, the waste toner container 9 may be attached to not to the inside but to the outside of the image forming apparatus, and may for example be attached separately to the back surface of the image forming apparatus. In this configuration, a mechanism is provided for conveying waste toner from the inside of the device body 2 to the waste toner container, which is disposed outside the image forming apparatus. Both the two configurations are applicable to the waste toner container that is provided for use in the image forming apparatus.

Moreover, the waste toner sensor 11 may be provided not on the side of the device body 2 but in the waste toner container 9.

Note that the shape, size, materials, and so on of the waste toner container 9, the conductive member 160, and so on are not limited to those described above, and are determined depending on the device configuration.

Further, the present invention may be any possible combination of the above embodiment and modifications.

<Brief>

The above embodiment and modifications represent one aspect for solving the problem described in Summary, and are summarized as in the following.

That is, a waste toner container that is provided for use in an image forming apparatus comprises: a body that receives, through an inlet thereof, waste toner discharged from the image forming apparatus, and contains therein the waste toner; a conveyance member that conveys the waste toner, which has been received through the inlet; a waste toner deposition chamber that is disposed downstream of the inlet in a waste toner conveyance direction such that the waste toner that has been conveyed by the conveyance member is increasingly deposited therein, the waste toner deposition chamber having a light-transmissive window through which an amount of the deposited waste toner is optically monitorable from outside of the body; a conductive member that is disposed on an inner surface of the body so as to come into contact with the waste toner that is being conveyed by the conveyance member; and a connection unit that is disposed between the conductive member and an earth member that is provided in the image forming apparatus to electrically connect between the conductive member and the earth member.

In the waste toner container, the conductive member may be disposed on at least one of a bottom surface and a side surface included in the inner surface of the body.

In the waste toner container, the conductive member may be sheet-like.

In the waste toner container, the connection unit may include: a first connection part that is electrically connected with the conductive member; and a second connection part that is electrically connected with the earth member, and the second connection part may be elastic, and may be pressed onto the earth member.

In the waste toner container, the conveyance member may be a rotary member that rotates around a rotational axis thereof along the waste toner conveyance direction, and may include a spiral part that applies a conveyance force in a rotational axis direction thereof to the waste toner.

In the waste toner container, the conveyance member may further include a stirring unit that applies a force in a rotational direction thereof to the waste toner, and the conductive member may face the stirring unit in the rotational axis direction.

The waste toner container may further comprise: a partition member that partitions an internal space of the body into an upper containing space and a lower containing space; and a communication member via which the upper containing space and the lower containing space are only partially communicated with each other, wherein the image forming apparatus may include: an image carrier; a developing unit that develops an electrostatic latent image on the image carrier with a developer to obtain a toner image; a transfer unit that transfers the toner image from the image carrier onto a recording sheet or transfers the toner image from the image carrier onto the recording sheet via an intermediate transfer member; and a cleaner that removes, as waste toner, residual toner on the image carrier or the intermediate transfer member after the toner image has been transferred, the developing unit may employ a trickle development system according to which while a developer including toner is supplied to a housing, part of the developer that has become excessive is discharged as waste toner, the conveyance member, the waste toner deposition chamber, and the conductive member may be disposed in the lower containing space, the waste toner discharged from the developing unit may be contained in the lower containing space through the inlet, and the waste toner removed by the cleaner may be contained in the upper containing space through another inlet of the body.

In the waste toner container, the lower containing space may have a smaller capacity than the upper containing space, and the waste toner deposition chamber may be positioned immediately below the communication member.

An image forming apparatus includes a waste toner container, the waste toner container comprising: a body that receives, through an inlet thereof, waste toner discharged from the image forming apparatus, and contains therein the waste toner; a conveyance member that conveys the waste toner, which has been received through the inlet; a waste toner deposition chamber that is disposed downstream of the inlet in a waste toner conveyance direction such that the waste toner that has been conveyed by the conveyance member is increasingly deposited therein, the waste toner deposition chamber having a light-transmissive window through which an amount of the deposited waste toner is optically monitorable from outside of the body; a conductive member that is disposed on an inner surface of the body so as to come into contact with the waste toner that is being conveyed by the conveyance member; and a connection unit that is disposed between the conductive member and an earth member that is provided in the image forming apparatus to electrically connect between the conductive member and the earth member.

With the above configuration, even when waste toner contained in the waste toner container is frictionally charged while being conveyed, it is possible to dissipate charge of the waste toner from the conductive member, which comes into contact with the waste toner, to the earth member provided in the image forming apparatus via the connection unit. As a result, compared with the configuration in which no mechanism for earthing the conductive member is provided, it is possible to reduce a charge amount of waste toner, thereby suppressing adherence of waste toner floating in the containing space to inner surfaces of light-transmissive windows by the action of an electrostatic force. This prevents erroneous sensing of full of waste toner due to adherence of lots of waste toner to the inner surfaces of the windows.

Although embodiments of the present invention have been described and illustrated in detail, it is clearly understood that the same is by way of illustration and example only and not limitation; the scope of the present invention should be interpreted by terms of the appended claims.

What is claimed is:

1. A waste toner container that is provided for use in an image forming apparatus, the waste toner container comprising:

a body that receives, through an inlet thereof, waste toner discharged from the image forming apparatus, and contains therein the waste toner;

a conveyance member that conveys the waste toner, which has been received through the inlet;

a waste toner deposition chamber that is disposed downstream of the inlet in a waste toner conveyance direction such that the waste toner that has been conveyed by the conveyance member is increasingly deposited therein, the waste toner deposition chamber having a light-transmissive window through which an amount of the deposited waste toner is optically monitorable from outside of the body;

a conductive member that is disposed on a wall of the body near the window and coming into contact with the waste toner that is being conveyed by the conveyance member, to dissipate a charge of waste toner in order to reduce adherence of the waste toner to the window; and a connection unit that is disposed between the conductive member and an earth member that is provided in the image forming apparatus to electrically connect between the conductive member and the earth member.

2. The waste toner container of claim 1, wherein the conductive member is disposed on a bottom portion of the wall of the body.

3. The waste toner container of claim 1, wherein the conductive member is sheet-like.

4. The waste toner container of claim 1, wherein the connection unit includes:

a first connection part that is electrically connected with the conductive member; and a second connection part that is electrically connected with the earth member, and the second connection part is elastic, and is pressed onto the earth member.

5. The waste toner container of claim 1, wherein the conveyance member is a rotary member that rotates around a rotational axis thereof along the waste toner conveyance direction, and includes a spiral part that applies a conveyance force in a rotational axis direction thereof to the waste toner.

6. The waste toner container of claim 5, wherein the conveyance member further includes a stirring unit that applies a force in a rotational direction thereof to the waste toner, and the conductive member faces the stirring unit.

7. The waste toner container of claim 1, further comprising:

a partition member that partitions an internal space of the body into an upper containing space and a lower containing space; and a communication member via which the upper containing space and the lower containing space are only partially communicated with each other, wherein the image forming apparatus includes:

an image carrier;

a developing unit that develops an electrostatic latent image on the image carrier with a developer to obtain a toner image;

a transfer unit that transfers the toner image from the image carrier onto a recording sheet or transfers the toner image from the image carrier onto the recording sheet via an intermediate transfer member; and a cleaner that removes, as waste toner, residual toner on the image carrier or the intermediate transfer member after the toner image has been transferred, the developing unit employs a trickle development system according to which while a developer including toner is supplied to a housing, part of the developer that has become excessive is discharged as waste toner, the conveyance member, the waste toner deposition chamber, and the conductive member are disposed in the lower containing space, the waste toner discharged from the developing unit is contained in the lower containing space through the inlet, and the waste toner removed by the cleaner is contained in the upper containing space through another inlet of the body.

8. The waste toner container of claim 7, wherein the lower containing space has a smaller capacity than the upper containing space, and the waste toner deposition chamber is positioned immediately below the communication member.

9. The waste toner container of claim 1, further comprising a screw, wherein the conductive member is disposed facing the screw.

10. The waste toner container of claim 1, wherein the waste toner deposition chamber is disposed midstream of a route where the conveyance member conveys the waste toner.

11. The waste toner container of claim 1, further comprising:

a partition member that partitions an internal space of the body into an upper containing space and a lower containing space located directly below the upper containing space, the partition member disposed between the upper containing space and the lower containing space, there being a hole formed through the partition member; and a communication member connected to the hole in the partition member and configured to allow waste toner in the upper containing space to enter the lower containing space, wherein the lower containing space receives waste toner through the inlet of the body, the upper containing space receives waste toner through another inlet of the body, and the conveyance member, the waste toner deposition chamber, and the conductive member are disposed in the lower containing space.

12. The waste toner container of claim 11, further comprising a second conveyance member, the second conveyance member disposed in the upper containing space and configured to rotate to move waste toner received in the upper containing space toward the communication member.

13. The waste toner container of claim 1, wherein the conductive member is disposed on a side portion of the wall of the body.

14. An image forming apparatus including a waste toner container, the waste toner container comprising:

a body that receives, through an inlet thereof, waste toner discharged from the image forming apparatus, and contains therein the waste toner;

a conveyance member that conveys the waste toner, which has been received through the inlet;

a waste toner deposition chamber that is disposed downstream of the inlet in a waste toner conveyance direction such that the waste toner that has been conveyed by the conveyance member is increasingly deposited therein, the waste toner deposition chamber having a light-transmissive window through which an amount of the deposited waste toner is optically monitorable from outside of the body;

a conductive member that is disposed on a wall of the body near the window and coming into contact with the waste toner that is being conveyed by the conveyance member, to dissipate a charge of waste toner in order to reduce adherence of the waste toner to the window; and a connection unit that is disposed between the conductive member and an earth member that is provided in the image forming apparatus to electrically connect between the conductive member and the earth member.

15. The image forming apparatus of claim 14, wherein the conductive member is disposed on a bottom portion of the wall of the body.

16. The image forming apparatus of claim 14, wherein the conductive member is sheet-like.

17. The image forming apparatus of claim 14, wherein the connection unit includes:

a first connection part that is electrically connected with the conductive member; and a second connection part that is electrically connected with the earth member, and the second connection part is elastic, and is pressed onto the earth member.

18. The image forming apparatus of claim 14, wherein the conveyance member is a rotary member that rotates around a rotational axis thereof along the waste toner conveyance direction, and includes a spiral part that applies a conveyance force in a rotational axis direction thereof to the waste toner.

19. The image forming apparatus of claim 18, wherein the conveyance member further includes a stirring unit that applies a force in a rotational direction thereof to the waste toner, and the conductive member faces the stirring unit.

20. The image forming apparatus of claim 14, wherein the waste toner container further comprises:

a partition member that partitions an internal space of the body into an upper containing space and a lower containing space; and a communication member via which the upper containing space and the lower containing space are only partially communicated with each other, wherein the image forming apparatus includes:

an image carrier;

a developing unit that develops an electrostatic latent image on the image carrier with a developer to obtain a toner image;

a transfer unit that transfers the toner image from the image carrier onto a recording sheet or transfers the toner image from the image carrier onto the recording sheet via an intermediate transfer member; and a cleaner that removes, as waste toner, residual toner on the image carrier or the intermediate transfer member after the toner image has been transferred, the developing unit employs a trickle development system according to which while a developer including toner is supplied to a housing, part of the developer that has become excessive is discharged as waste toner, the conveyance member, the waste toner deposition chamber, and the conductive member are disposed in the lower containing space, the waste toner discharged from the developing unit is contained in the lower containing space through the inlet, and the waste toner removed by the cleaner is contained in the upper containing space through another inlet of the body.

21. The image forming apparatus of claim 20, wherein the lower containing space has a smaller capacity than the upper containing space, and the waste toner deposition chamber is positioned immediately below the communication member.

22. The image forming apparatus of claim 14, further comprising a screw, wherein the conductive member is disposed facing the screw.

23. The image forming apparatus of claim 14, wherein the waste toner deposition chamber is disposed midstream of a route where the conveyance member conveys the waste toner.

24. The image forming apparatus of claim 14, further comprising:

an image carrier;

a developing unit that develops an electrostatic latent image on the image carrier with a developer to obtain a toner image, the developing unit discharging an excess amount of developer as waste toner;

a transfer unit that transfers the toner image from the image carrier onto a recording sheet or transfers the toner image from the image carrier onto the recording sheet via an intermediate transfer member; and a cleaner that removes, as waste toner, residual toner on the image carrier or the intermediate transfer member after the toner image has been transferred, wherein the waste toner container further comprises a partition member that partitions an internal space of the body into an upper containing space and a lower containing space located directly below the upper containing space, the partition member disposed between the upper containing space and the lower containing space, there being a hole formed through the partition member, and a communication member connected to the hole in the partition member and configured to allow waste toner in the upper containing space to enter the lower containing space, wherein the lower containing space receives waste toner, which was discharged from the developing unit, through the inlet of the body, the upper containing space receives waste toner, which was removed by the cleaner, through another inlet of the body, and the conveyance member, the waste deposition chamber, and the conductive member are disposed in the lower containing space.

25. The image forming apparatus of claim 24, wherein the waste toner container further comprises a second conveyance member, the second conveyance member is disposed in the upper containing space and is configured to rotate to move waste toner received in the upper containing space toward the communication member.

26. The image forming apparatus of claim 14, wherein the conductive member is disposed on a side portion of the wall of the body.

* * * * *